US005653432A

United States Patent [19]

Hänsch

[11] Patent Number: 5,653,432

[45] Date of Patent: Aug. 5, 1997

[54] CONVEYING DEVICE FOR FEEDING SHEET-LIKE PRODUCTS TO A PROCESSING MACHINE FOR PRINTED PRODUCTS

[75] Inventor: Egon Hänsch, Wetzikon, Switzerland

[73] Assignee: Ferag AG, Hinwil, Switzerland

[21] Appl. No.: 520,126

[22] Filed: Aug. 28, 1995

[30] Foreign Application Priority Data

Aug. 31, 1994 [CH] Switzerland ..... 02667/94

[51] Int. Cl.[6] ..... B65H 29/06

[52] U.S. Cl. ..... 271/82; 271/204

[58] Field of Search ..... 271/277, 72, 204, 271/205, 82

[56] References Cited

U.S. PATENT DOCUMENTS

| | | | |
|---|---|---|---|
| 2,195,849 | 4/1940 | Carroll . | |
| 4,307,801 | 12/1981 | Hansch . | |
| 5,275,685 | 1/1994 | Stauber . | |
| 5,324,014 | 6/1994 | Honegger et al. . | |
| 5,350,167 | 9/1994 | Hansch . | |
| 5,351,946 | 10/1994 | Kamoda et al. . | |
| 5,380,000 | 1/1995 | Ohno | 271/204 X |
| 5,425,837 | 6/1995 | Hansch . | |

FOREIGN PATENT DOCUMENTS 30 02 591 9/1980 Germany .

*Primary Examiner*—David H. Bollinger

*Attorney, Agent, or Firm*—Brinks Hofer Gilson & Lione

[57] ABSTRACT

A conveying device for feeding sheet-like products to a processing machine for printed products having carrying elements that rotate in the direction of rotation (U) along a self-contained rotational path. A carrying arm and a link member are pivoted on each carrying element. The clamping jaws, which form a clamp and are prestressed in the closed direction, and are pivotally mounted on the carrying arm. The first clamping jaw being connected to the link member in order to pivot the clamp. The second clamping jaw is connected to an opening roller with which an opening guide interacts to open the clamp. The pivot position of the carrying arms and the position of the link member can be controlled independently of one another by the control device, with the result that the clamp may also be pivoted about its pivot on the carrying arm independently of a movement of the carrying arm. The conveying device is suitable for depositing folded printed sheets in a straddling manner on the rest of the processing machine.

12 Claims, 5 Drawing Sheets

CONVEYING DEVICE FOR FEEDING SHEET-LIKE PRODUCTS TO A PROCESSING MACHINE FOR PRINTED PRODUCTS

BACKGROUND OF THE INVENTION

The present invention relates to a conveying device for feeding sheet-like products to a processing machine for printed products, and to an apparatus for processing printed products.

A conveying device of this type is disclosed in U.S. patent application Ser. No. 08/409,792, which by reference is hereby incorporated as a part of this disclosure. This application claims priority under Switzerland Patent Application No. 00 887/94-6, that was filed on Mar. 24, 1994. The machine disclosed in U.S. application Ser. No. 08/409,792 uses a rotationally driven carrier wheel on which there are fastened carrying elements which are distributed circumferentially thereof. Each carrying element includes a carrying arm and link member that are pivoted about pivot pins parallel to the axis of rotation of the carrier wheel. At the free end region of each carrying arm there is arranged, on the carrying arm, a bearing shank which is parallel to the axis of rotation. On the bearing shank there are pivotally mounted two interacting clamping jaws which are prestressed in the closed direction. A first of the clamping jaws is connected to the link member that functions to pivot the clamp about its pivot point on the carrying arm. The pivot position of the carrying arms and the position of the link members are separately controlled to thereby pivot the clamp independently of the pivot movement of the carrying arms. This permits the clamp to move in the direction of rotation relative to the carrying elements, and to control the pivot position of the clamps. This arrangement provides particular advantages upon receiving and discharging the products and, if appropriate, when the products are being guided past processing stations in a defined position and at a given speed. Before a product is received, the clamps are rotated into a position at which the mouth formed by the clamping jaws is directed forward in the direction of rotation. In this arrangement, a stop element connected to the second clamping jaw, which is located radially on the outside in this position, comes to bear against a counter-stop on the carrying arm. As a result, the second clamping jaw is prevented from further following the further pivot movement, controlled by the link member of the first clamping jaw. This results in the opening of the clamp. In order to discharge the products to the processing machine, the clamps are introduced with the mouth directed approximately radially outward, between in each case two successive wall elements of the processing machine. The relevant carrying arm is then pivoted forward in the direction of rotation until the second clamping jaw is supported, by means of a press-on roller mounted at its free end, via the product on the wall element which proceeds in the direction of rotation. Upon subsequent pivoting of the first clamping jaw by means of the link member, the second clamping jaw is thus prevented from pivoting along therewith, which results in the clamps being opened and the product being released.

The conveying device is intended, and suitable, for introducing products into pocket-like receiving parts formed by adjacent wall elements and for releasing the products by pressing against a wall element.

A conveying device for feeding sheet-like products to a processing machine for printed products is also disclosed in U.S. patent application Ser. Nos. 08/173,967 and 08/173,374 and the corresponding European Applications EP-A-0 606 550 and EP-A-0 606 549. These applications disclose a rotationally driven carrier wheel on which controllable clamps are arranged, through a carrying arm and link member, are hereby incorporated by reference as a part of this disclosure. The clamps are spaced at intervals along the circumference of the carrier wheel. The carrying arm and link member are mounted on the carrier wheel such that they can be pivoted about pins parallel to the axis of rotation of the wheel. In this arrangement, the position of the respective clamp is controlled in dependence on the pivot position of the relevant carrying arm in the manner of a four-bar mechanism. If the carrying arm is pivoted to the rear, as seen in the direction of rotation, the mouth of the clamp is directed forward. It assumes this position as it moves through a receiving region, in which it grasps a product by its trailing edge, as seen in the direction of rotation. The grasped product is fed to the receiving region, and is conveyed therein, by means of a belt conveyor. The product is conveyed tangentially with respect to the movement path of the clamp, but at a lower speed than the clamp. When the carrying arm is pivoted out of its rearwardly directed end position into an approximately radial position, the clamp is pivoted, in dependence on the movement of the carrying arm, counter to the direction of rotation The product is thereby introduced, in a transfer region, between wall elements of a processing machine. The product is thus deposited upon a printed product that is resting on one of the wall elements or it is released in a controlled manner. The two clamping jaws of the clamp are pivotally mounted on the corresponding carrying arm. One of the clamping jaws is articulated on the link member and the other of the clamping jaws is articulated on a crank-drive-like opening member. The opening member has a follow-on roller that interacts with an opening guide to open the clamp in the receiving region and in the transfer region. In order to ensure that the products are grasped by the clamps in the receiving region, the products are conveyed in the direction of rotation, but at a lower speed.

SUMMARY OF THE INVENTION

The object of the present invention is to provide a versatile conveying device for feeding sheet-like products to a processing machine for printed products, which permits careful handling of the products along with a high processing capacity.

The invention comprises a conveying device for feeding sheet-like products to a processing machine for printed products. A stationary framework has a carrier mounted for rotation thereon about an axis. Carrying elements are secured to a carrier and arranged one behind the other such that they are driven in the direction of rotation along a self-contained rotational path. A carrying arm and a link member are pivotally connected to the carrying element. A clamp is provided which includes first and second interacting clamping jaws that are pivotally mounted on carrying arms, with the clamping jaws being prestressed in the closed direction. The first clamping jaws are connected to a link member for pivoting said clamp and a stationary actuating member that is secured to the machine's stationary framework. The opening members are supported on the carrying arms connecting the second clamping jaws to an opening member and providing a control device that functions to control carrying arms and link members separately in order also to pivot the clamps about their pivotal connection on the carrying arms independently of the movement of the carrying arms.

The conveying device according to the invention has the advantages over the prior art in that it makes it possible for the clamps to be opened in any pivot position. The conveying device, according to the invention, can thus be used in an extremely versatile manner. It is possible to open the clamps without one of the clamping jaws being supported on the carrying arm or on the processing machine.

An embodiment of the present invention will now be described in more detail with reference to an exemplary embodiment that is represented in the drawings.

DETAILED DESCRIPTION OF THE PREFERRED EMBODIMENT

Figure 1:
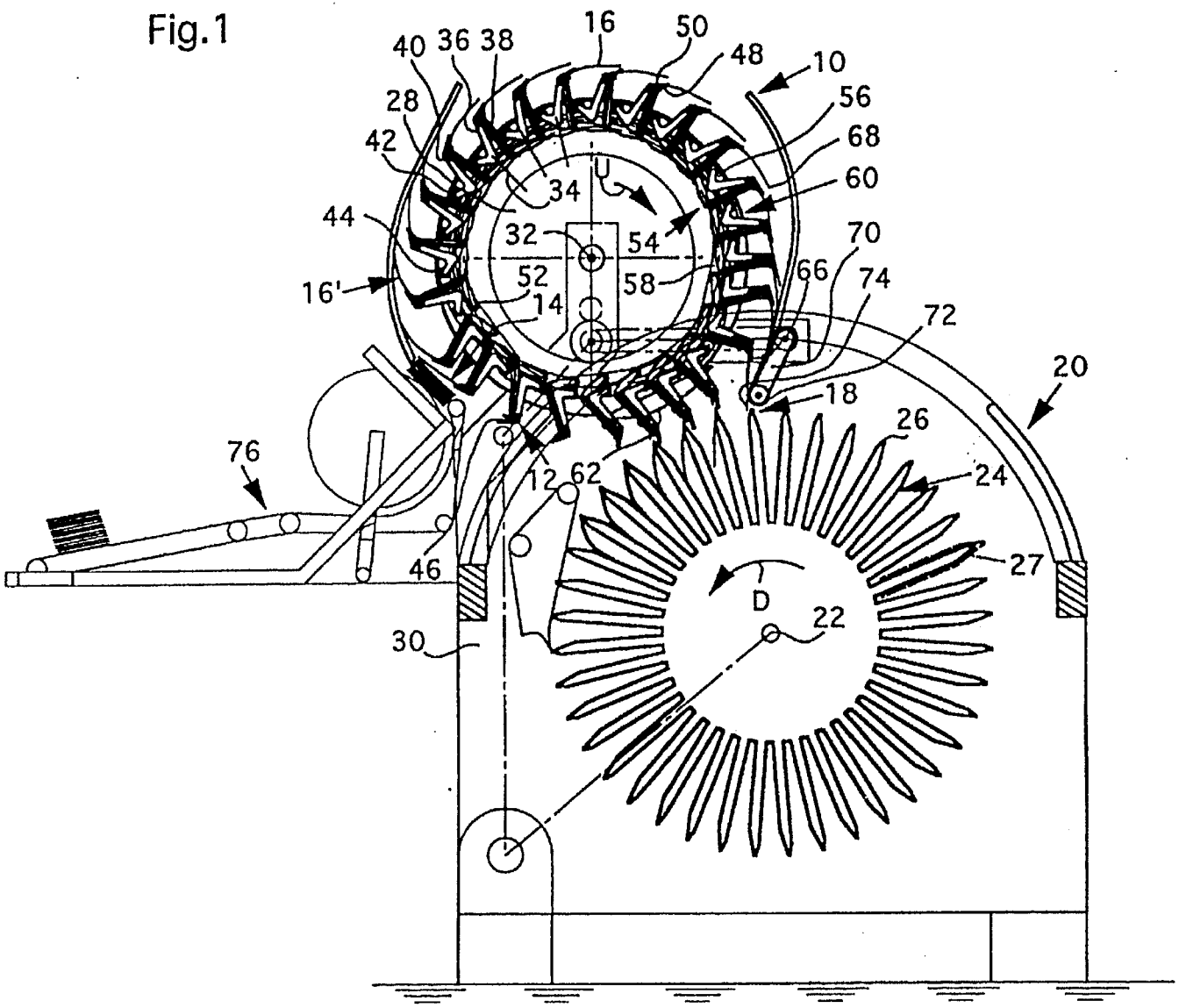
FIG. 1 is a schematic end view of an apparatus for processing printed products, including a drum-like processing device to which sheet-like products received from a stack are fed by means of a conveying device.

An embodiment of an apparatus for processing printed products having a conveying device 10 including clamps 12 is shown in a simplified form in FIG. 1. The clamps 12 are arranged one behind the other in the direction of rotation U and each are intended to grasp one product 16'. In FIG. 1 the product 16' is a folded printed sheet 16, called an insert. The products 16' are grasped as the clamp 12 moves past a delivery location 14 and the products are carried to a transfer region 18, where the products 16' are discharged to a processing machine 20. A processing machine 20 of this type is shown and described in detail in U.S. Pat. No. 5,324,014 and the corresponding EP-A-0 550 828 application. The processing machine 20 includes wall elements 24 which are distributed uniformly in the circumferential direction about a drum axis 22. The wall elements 24 are arranged radially and their radially outer ends form saddle-like rest 26 which extend parallel to the drum axis 22 and are intended to receive the printed sheets 16 and additional printed products 27 which are to be processed.

The conveying device 10 includes a carrier wheel 28 that is mounted on a machine framework 30. The carrier wheel 28 has an axis of rotation 32 that extends parallel to the drum axis 22 and is driven in the direction of rotation U which is the reverse of the direction of rotation D of the processing machine 20. Extension-arm-like carrying elements 34 are fastened to and distributed uniformly, in the circumferential direction. Each extension-arm-like carrying element 34 has one carrying arm 36 and one link member 38 pivotally mounted thereon. The carrying elements 34 thus rotate around the axis of rotation 32 along a self-contained circular rotational path.

Figure 2:
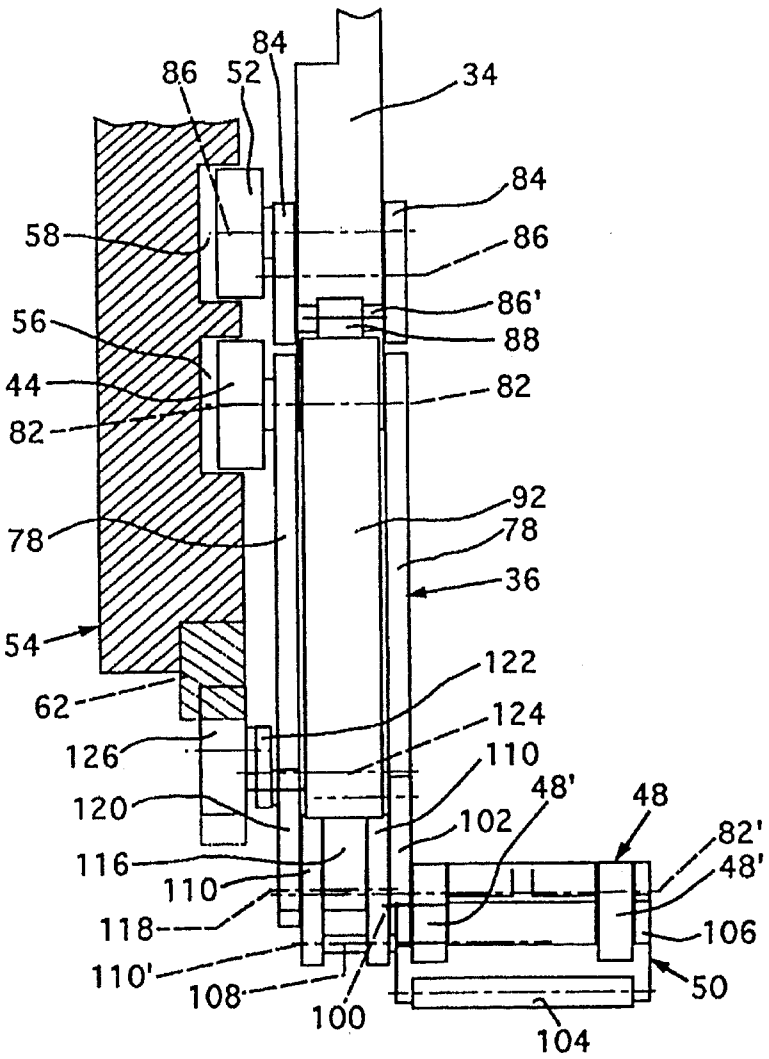
FIG. 2 is a side view, partially in section of the conveying device shown in FIG. 1.
Figure 3:
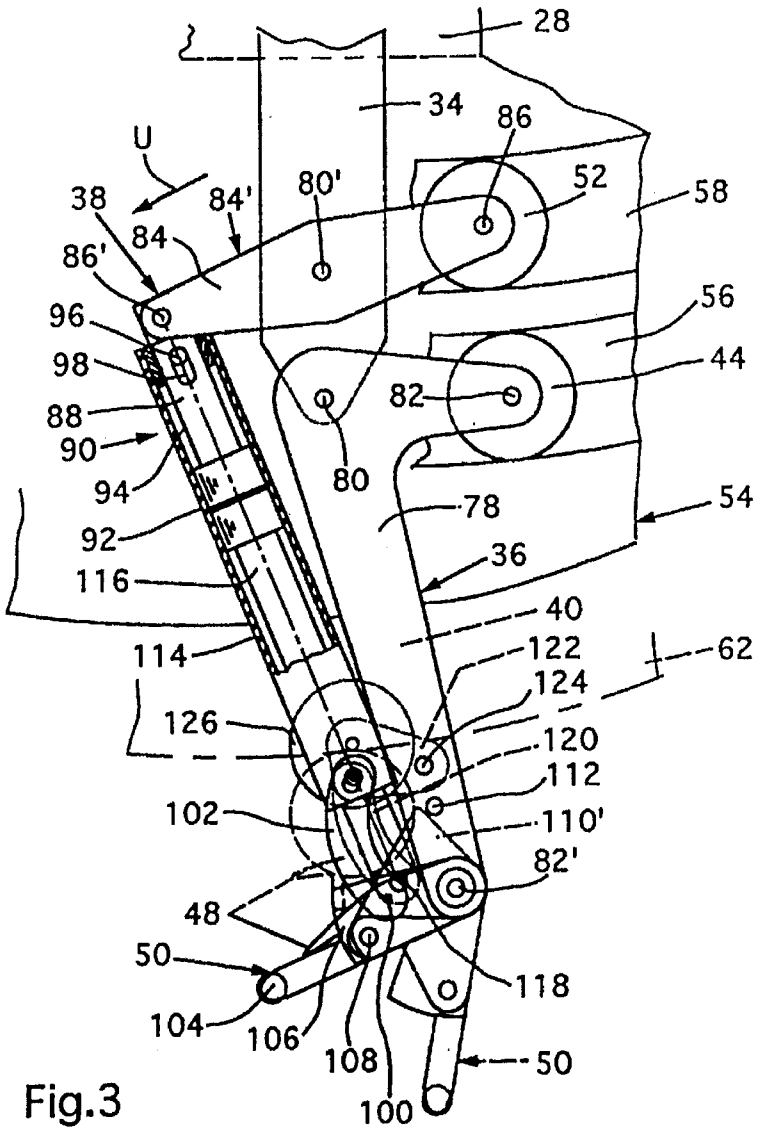
FIG. 3 is an elevation view, partially in section, of the part of the conveying device that is shown in FIG. 2.

Referring now to FIGS. 2 and 3 the carrying arms 36 include a two-armed angle lever, on whose one arm 40 a clamp 12 is pivotally mounted and on whose other arm 42 a follow-on roller 44 is rotatably mounted.

Each clamp 12 has two interacting clamping jaws 48, 50 which form a clamp mouth 46. The first clamping jaw 48 is connected to the relevant link member 38 that functions to pivot the clamp 12. A control roller 52 is rotatably mounted on the link member 38.

Figure 4:
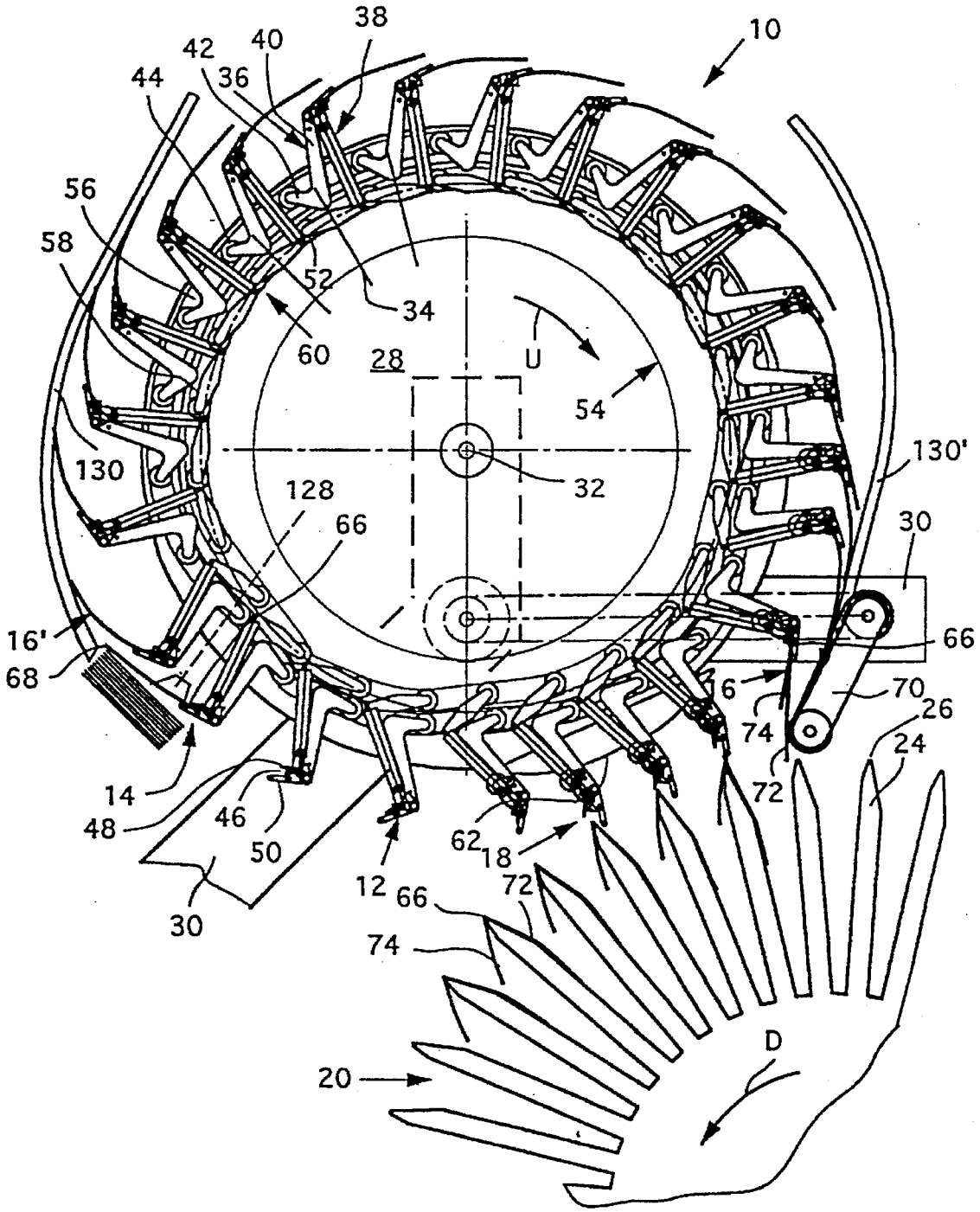
FIG. 4 is an enlarged view of the conveying device, seen in FIG. 1, and also discloses a portion of the processing machine.

As best seen in FIG. 4, a control ring 54 that is fastened to the machine framework 30 includes two self-contained, groove-like control guides 56, 58 which extend around the carrier wheel 28. The follow-on rollers 44 that are mounted on the carrying arms 36 are guided in the first control guide 56. The control rollers 52, that act on the link members 38, are guided in the radially inner second control guide 58. The first control guide 56 thus determines the pivot position of the carrying arms 36 and the second control guide 58 determines the pivot position of the clamps 12 that are mounted on the carrying arms 36. The control ring 54 along with the control guides 56, 58 and the follow-on and control rollers 44, 52 thus form a control device 60 for controlling the carrying arms 36 and link members 38. This control device 60 functions to pivot the clamps 12 about their pivots on the carrying arms 36 independently of the pivot movement of the carrying arms 36.

Figure 5:
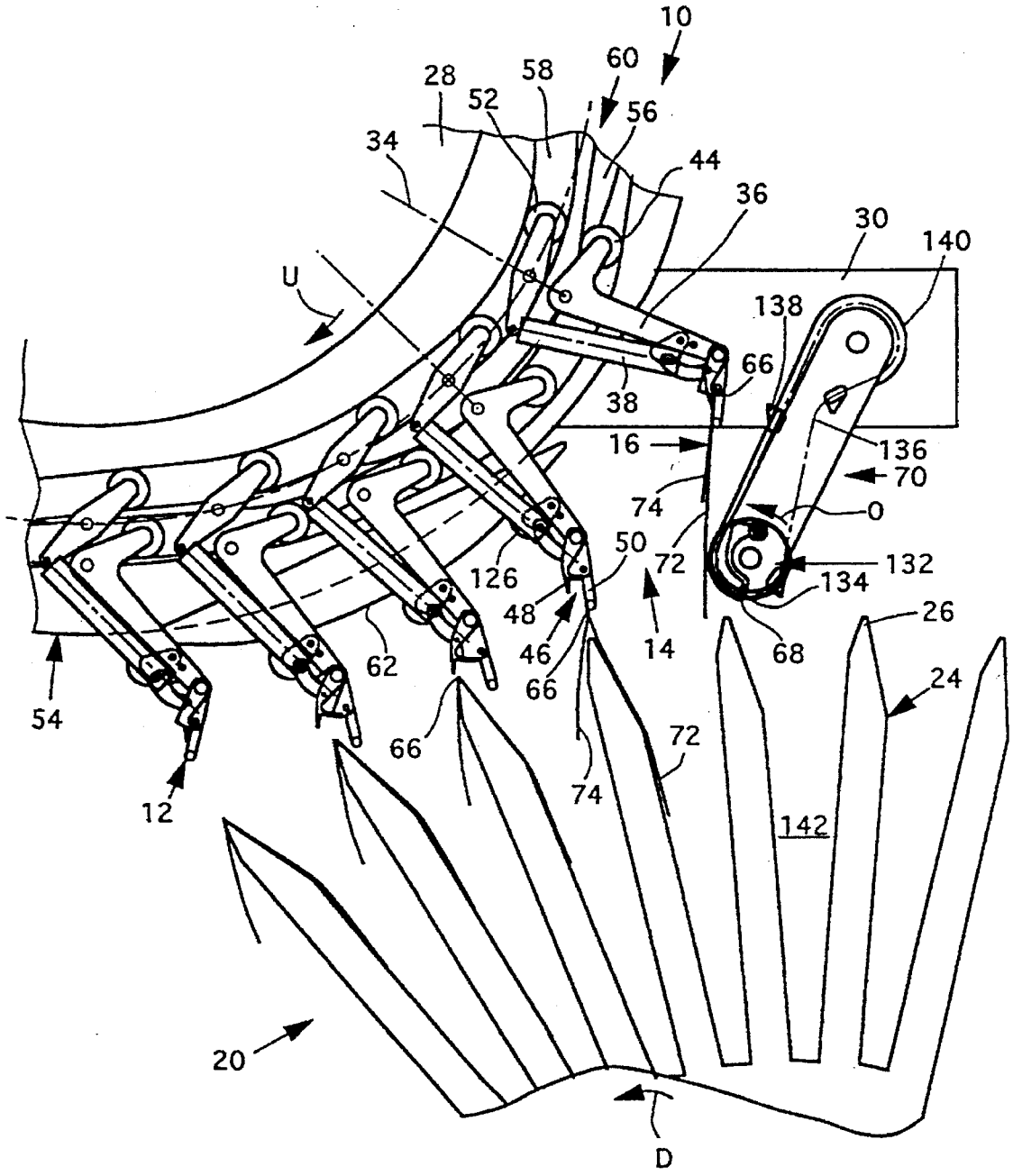
FIG. 5 is an enlarged view of a portion of FIG. 4, including the interaction of the conveying device with an opening unit and the processing machine.

In addition, a stationary opening guide 62, see FIG. 5, is provided in the transfer region 18, which reacts with the second clamping jaw 50 to open the clamp 12.

The clamps 12 are intended for grasping, at the delivery location 14, in their clamp mouth 46 which is directed forward in the direction of rotation U, a folded printed sheet 16 at its fold 66. The clamps 12 then feed said printed sheet to the transfer region 18 with the edge 68, which is located opposite said fold 66, in front to an opening unit 70. The opening unit 70 is located at the beginning of said transfer region 18. The opening unit 70 grasps the printed-sheet part 72 in a border region that is located opposite the fold 66 and raises the printed-sheet 72 up from the other, second printed-sheet part 74. The result is that a wall element 24 of the processing machine 20 can move in between the raised-apart printed-sheet parts 72, 74. The opening unit 70 then releases the first printed-sheet part 72, whereupon the clamps 12 are opened in the end region of the transfer region 18 by means of the opening guide 62 in order to release the printed sheets 16. The printed sheets 16 then drop in a straddling manner onto the saddle-like rests 26 or onto printed products 27 which are already arranged on the said rests.

A feed device 76 performs the function at the delivery location 14 of providing, for each clamp 12, a product 16', in the preferred embodiment disclosed herein a printed sheet 16 in the correct position. The feed device 76 shown in FIG. 1 is disclosed in U.S. patent application Ser. No. 08/409,799, filed on Mar. 23, 1995 and the corresponding Swiss Patent Application No. 00 886/94-4. A further feed device suitable for the same purpose is shown and described in the above identified U.S. patent application Ser. No. 08/409,792. U.S. patent application Ser. No. 08/409,799 is hereby incorporated herein by reference and included as a part of this disclosure. As far as the construction and mode of functioning of the feed devices 76 are concerned, express reference is made to these documents.

The construction of the clamps 12 and the control thereof will now be described in more detail with respect to FIGS. 2 and 3. The carrying arm 36 has two identical carrying-arm parts 78, which are each arranged on one side of the carrying element 34 and are mounted on the carrying element 34 by means of a pivot pin 80. The carrying-arm parts 78 are connected at both ends, to one another by bearing shanks 82, 82'. The follow-on roller 44 is mounted on the first bearing shank 82, at one end of the carrying arm 36. The two clamping jaws 48, 50 of the clamp 12 are mounted on the second bearing shank 82' at the other end of the carrying arm 36.

The link member 38 has a two-armed control lever 84' that is made up of two sub-levers 84 that are of the same shape. Each sub-lever 84 is arranged on one side of the carrying element 34 and are mounted thereon by means of another pivot pin 80'. The two sub-levers 84 are connected to one another at their ends by additional bearing shanks 86, 86'. Control roller 52 is rotatably mounted on the bearing shank 86 and a shank-like connecting member 88 of a connecting rod 90 is pivoted on the bearing shank 86'. The connecting member 88 is guided by and slides in a connecting-rod tube 92. A compression spring 94 acts against the end of the connecting-rod tube 92 which faces the control lever 84 and the end of the connecting member 88 which is remote from the control lever 84'. The relative displacement between the connecting-rod tube 92 and the connecting member 88 in the longitudinal direction of the connecting rod 90 is restricted by a limiting pin 96 that extends through a slot 98 formed in the connecting member 88 and is fastened to the connecting-rod tube 92. Under normal operating conditions, the connecting-rod tube 92 assumes, with respect to the connecting member 88, the position which is shown in FIGS. 2 and 3. In this position the control-lever-side end of the slot 98 that is closed to the control lever 84', bears against the limiting pin 96.

The first clamping jaw 48 comprises two tongue-like clamping-jaw parts 48' which are connected by a connecting pivot pin 100. The tongue-like clamping-jaw parts 48' are pivotally connected to a butt strap 102 and pivot together as a fixed unit. The other end of the butt strap 102 is pivotally connected to the connecting-rod tube 92.

The second clamping jaw 50, which is located on the outside relative to the first clamping jaw 48, as seen in the radial direction relative to the axis of rotation 32, has a plate-like construction and includes a press-on roller 104 at its free end. The free end having the press-on roller 104 is the leading end as seen in the direction of rotation U and projects beyond the clamping-jaw parts 48'. The second clamping jaw 50 has, in the central region, a driver stop 106 which forms the inner end of the clamp mouth 46. The driver stop 106 has clearances through which the clamping-jaw parts 48' engage in order to permit the relative movement between the clamping jaws 48, 50. The second clamping jaw 50 is connected to the two identically shaped triangular parts 110 of a stop element 110' by a connecting pin 108 that extends parallel to the bearing shank 82'. The parts 110 are seated in a freely rotatable manner on the bearing shank 82', between the two carrying-arm parts 78. The stop element 110' interacts with a stop pin 112 which connects the two carrying-arm parts 78 to one another. When the stop element 110' butts against the stop pin 112, the second clamping jaw 50 is located at an end position at which it extends approximately at right angles to the associated arm 40 of the carrying arm 36. The second clamping jaw 50 can only be moved out of this position in the counter-clockwise direction. (see FIG. 3)

Arranged in the connecting-rod tube 92 is a compression spring which forms a closure spring 114 for the clamping jaws 48, 50. Spring 114 is supported, at one end, on the clamp-side end of the connecting-rod tube 92 and at the other end, by a pull rod 116 which extends through the interior of the connecting-rod tube 92, through the closure spring 114 and is connected to the parts 110 of the stop element 110'. The end of the pull rod 116 is connected to parts 110 by a pivot pin 118. The closure spring 114 is subjected to prestressing and acts through the pull rod 116 on the second clamping jaw 50. The other end of closure spring 114 acts on the first clamping jaw 48 through the butt strap 102 in the closure direction. The force of the closure spring 114 is less than the prestressing force of the compression spring 94.

Reference is hereby made to the above identified U.S. patent application Ser. No. 08/409,792 for a detailed disclosure of the function of the clamp 12 and the control thereof.

An opening butt strap 120 is also pivoted on pivot pin 118. The other end of butt strap 120 is pivotally connected to a triangle lever 122. Triangle lever 122 is pivotally mounted on the carrying arm 36 by a pin 124 which connects the two carrying-arm parts 78 to one another. An opening roller 126 is mounted for free rotation on the triangle lever 22 which is intended for interacting with the opening guide 62. As is indicated by broken lines in FIG. 3, the interaction of the opening roller 126 with the opening guide 62, that is fastened on the control ring 54, the second clamping jaw 50 is raised from the first clamping jaw 48. Raising the second clamping jaw 50 in opposition to the force of the closure spring 114, opens the clamp 12. As a result of pivoting the second clamping jaw 50 on the opening roller 126 through a linkage, the movement space for the products 16' is kept clear.

The clamp 12 shown in the figures can be opened in three different manners:

First, by the opening guide 62 acting on the opening roller 126, as a result of which the second clamping jaw 50 is pivoted in the counter-clockwise direction, as is indicated by broken lines in FIG. 3. The pivot position of the first clamping jaw 48 is given by the control device 60.

Second, if the clamp 12 is pivoted in the clockwise direction by pivoting the control lever 84' by means of the control device 60, and the stop element 110' thereby comes to bear against the stop pin 112, upon further pivoting of the clamp 12 in the same direction, the second clamping jaw 50 is prevented from following the pivot movement of the first clamping jaw 48, with the result that the two clamping jaws 48, 50 are likewise raised apart from one another. This is indicated in FIG. 3 by means of the broken-line pivot position of the first clamping jaw 48.

Third, the clamp 12 can be opened in that a wall element 24 of the processing machine 20 is used to act on the press-on roller 104 and thus on the second clamping jaw 50 in the counter-clockwise direction, as is fully disclosed in the above identified U.S. patent application Ser. No. 08/409,792. This mode of operation makes it possible for the products 16' to be placed on top of a printed product 27 that is already resting on the wall element 24.

As best illustrated in FIG. 4, the clamps 12, before they reach the delivery location 14, are opened in the second manner described. This enables the clamps 12 to grasp, in the open clamp mouth 46 which is directed forward as seen in the direction of rotation U, a product 16'. The product 16' is raised from a stack by a suction-head arrangement 128, as is indicated by broken lines, at its trailing edge. If the product is a folded printed sheet 16 then it is lifted at its fold 66. In this arrangement, the open clamp 12 runs onto the product 16' by means of its driver stop 106 and carries it along in the direction of rotation U. By pivoting the first clamping jaw 48 in the counter-clockwise direction, the clamp 12 is closed, whereupon the product 16 is fixed in the clamp mouth 46. As seen in FIG. 4, when the clamp 12 runs onto the product 16' to be grasped, the carrying arm 36 is pivoted counter to the direction of rotation U by means of the control device 60. This results in the relative speed between the clamp 12 and the products 16' to be grasped being reduced with respect to the speed which the clamp 12 would assume if the carrying arm 36 were to maintain its pivot position with respect to the carrier wheel 28. This reduction in speed permits careful handling of the products 16' and a high processing capacity of the apparatus. When the clamp mouth 46 is closed, the pivot position of the clamp 12 is determined by the control device 60, through the link member 38.

The edge 68, which leads with respect to the trailing fold 66, is guided by a guide plate 130 in order to prevent the printed sheets 16 from bending backwards due to the air pressure. After a printed sheet 16 has been received, the carrying arms 36 are each pivoted in the direction of rotation U, whereupon the air pressure on the products 16' is reduced.

The opening and subsequent depositing of the folded printed sheets 16 will now be described in more detail with reference to FIG. 5. The opening unit 70 has a opening roller 132 which is rotatably driven in the direction of the arrow O and is provided with a suction head 134 which is connected to a vacuum source through a valve arrangement (not shown) within a specific rotational region of the opening roller 132. The suction head 134 is intended for grasping the first printed-sheet part 72, facing the opening unit 70, in a border region located opposite the fold 66 and holding it until the wall element 24 of the processing machine 20 has moved in between the separated printed-sheet parts 72, 74. In order to ensure that the first printed-sheet part 72 is grasped by the suction head 134, the leading edge 68 of the first printed-sheet part 72 is guided by means of cams 138 which are driven in circulation along a closed movement path 136. Preferably, the cams 138 are arranged on a chain which is guided, at one end, about the axis of the opening roller 132 and, at the other end, about a deflection wheel 140 which is arranged upstream of said opening roller 132. Opening units 70 of this type are known in general. The opening unit 70 is adjustably arranged on the machine framework 30 in order to permit adaptation to the products 16' which are to be processed. In order to direct the leading edge 68 of the printed sheets 16 to the movement path 136 of the cams 138, a further guide plate 130' is arranged upstream of the opening unit 70.

As is seen in FIG. 4, before the leading edge 68 of the printed sheets 16 reaches the opening unit 70 the clamps 12 are delayed and then accelerated, in order to ensure that the first printed-sheet part 72 engages the cam 138. The delay and acceleration of the clamps 12 is caused by the pivoting of carrying arm 36.

As best seen in FIGS. 4 and 5, in the initial section of the transfer region 18, the carrying arms 36 are pivoted forward in the direction of rotation U while at the same time the clamps 12 are pivoted in the opposite direction as a result of link member 38. As a result, while in the transfer region 18, the clamp mouth 46 is essentially in alignment with and directed towards the wall element 24. In the finale section of the transfer region 18, the opening roller 126, engages the opening guide 62, which causes the clamp 12 to be opened in the manner described above, and thus releases the printed sheet 16. The printed sheet 16 then drops in a straddling manner onto the rest 26. After the clamp 12 is opened, the carrying arm 36 is pivoted counter to the direction of rotation U in order to prevent the clamp 12 from coming into contact with the processing machine 20 or with the printed sheets 16 and printed products 27 that have been deposited on the wall elements 24.

Figure 6:
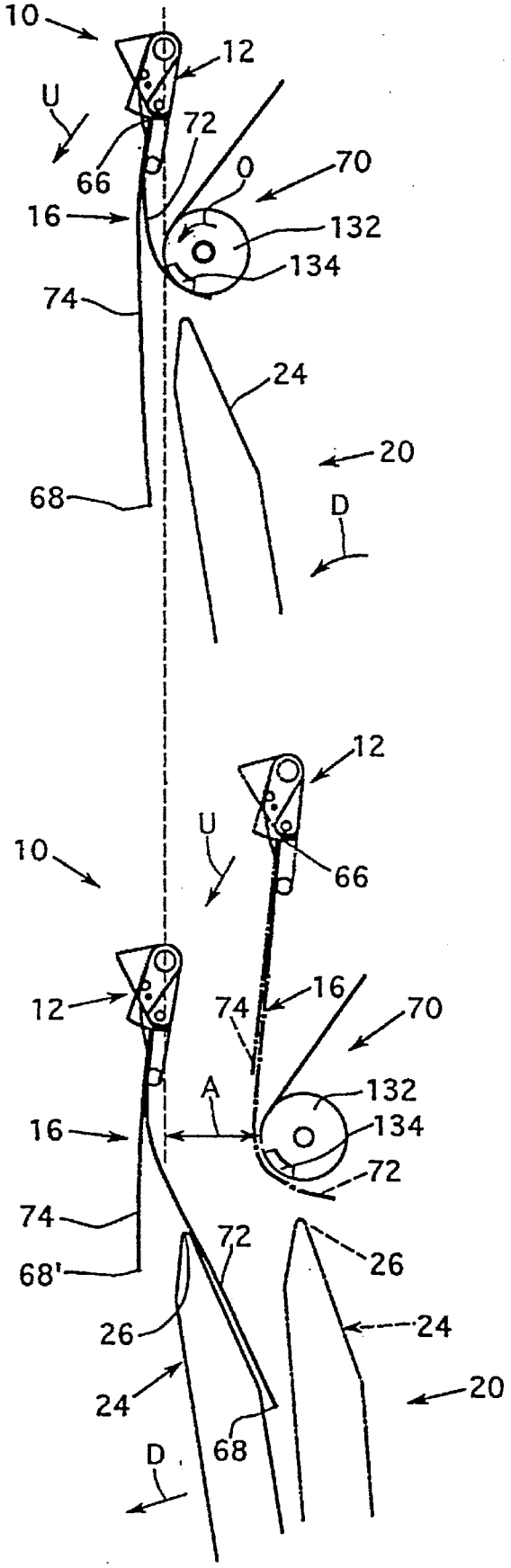
FIG. 6 includes an upper and a lower view that compares different embodiments of the arrangements of the opening unit that open products that are folded in an off-center manner and are retained in a different manner by the clamps.

FIG. 6 shows a portion of the opening unit 70, a wall element 24 of the processing machine 20 and a clamp 12 which retains a printed sheet 16 that is folded in an off-center manner. In the embodiment shown at the top in FIG. 6, the printed sheet 16 is retained such that the first printed-sheet part 72, which is shorter in relation to the second printed-sheet part 74, faces the opening unit 70 and the second printed-sheet part 74 faces the axis of rotation 32. The second printed-sheet part 74 is introduced, with its leading edge 68 in front of the wall element 24 that is illustrated and a second wall element 24 that precedes the illustrated wall element 24 in the direction of rotation D. The first printed-sheet part 72 is grasped and held by the suction head 134 and curved around the opening roller 132, while the wall element 24 moves beneath the opening roller 132 and comes to engage the second printed-sheet part 74 and carries the latter along with it. The suction head 134 is then supplied with air under positive pressure, as a result of which the two printed-sheet parts 72, 74 then straddle the wall element 24 and the rest 26.

In the embodiment shown at the bottom of FIG. 6, the printed sheet 16 is retained in the clamp 12 such that the first printed-sheet part 72 facing the opening unit 70 projects beyond the second printed-sheet part 74 facing the axis of rotation 32. As is indicated by the arrow A, in this embodiment, the opening unit 70 is located such that it trails in the direction of rotation D, as compared to the embodiment shown at the top of FIG. 6. This trailing location assures that the longer, first printed-sheet part 72 can be grasped by the suction head 134 before it projects into the movement path of the wall elements 24. As is indicated by broken lines, the wall element 24 may thereby move past beneath the opening roller 132 and the first printed-sheet part 72 curved around said roller, whereupon the suction head 134 is supplied with air under positive pressure. The first printed-sheet part 72 thus will engage the rear side of the wall element 24, whereas the second printed-sheet part 74 is then introduced, with its leading edge 68' in front, between the wall element 24 and the wall element preceding this in the direction of rotation U, as is shown by solid lines. The printed-sheet parts 72, 74 thus engage from the top, over the wall element 24 onto the rest 26.

Since both carrying arm 36 and link member 38 are controlled independently of each other, the position of the clamp 12 with respect to the carrier wheel 28 can be changed to a considerable extent and the position of the opening unit 70 can be adjusted. As a result it is possible to process printed sheets 16 which are of extremely different formats and are folded in a vast number of different ways.

Using the apparatus described above, it is also possible to introduce printed sheets 16 or other products 16' such as cards or the like into pocket-like receiving parts 142 that are formed between adjacent wall elements 24. As best illustrated with reference to FIG. 5, the phase position between the processing machine 20 and the conveying device 10 would, for this purpose, be changed by half a cycle, and the opening unit 70 would be shifted out of the region in which it acts on the products 16'. The processing machine 20, or at least the suction head 134, will be permanently disconnected from the vacuum source.

It is also possible using the conveying device 10 for products 16' to engage the wall elements 24 or printed products 27 resting thereon and to be pressed against said wall elements or printed products as is described in detail in the above identified U.S. patent application Ser. No. 08/409,792. In this embodiment the opening guide 62 is non functional. The opening guide 62 is thus fastened to the control ring 54 such that it can be removed. It is, of course, also conceivable to arrange the opening guide 62 such that it is movable and can be brought into and out of the operating position by means of a control element, for example a cylinder/piston unit.

It is also conceivable to open the clamps 12, for receiving a product 16' by means of an opening guide 62. In this case, the stop pin 112 can be eliminated.

It should also be noted that the carrying elements 34 may be arranged on an endless pulling member, for example a chain that is guided around deflection wheels or in a duct. The circulatory path of the carrying element 34 may thus be of any shape.

Although the processing machine 20 that has been illustrated includes a circular drum, the wall elements 24 could be arranged on a circulating conveyor with the result that they circulate for example, along an elongate oval movement path.

It is also possible to eliminate the press-on roller 104, or an element with the same function, if the process being performed does not require that the products 16' be pressed against a wall element 24 by means of the conveying device 10.

It is intended that the accompanying drawings and foregoing detailed description are to be considered in all respects as illustrative and not restrictive; the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. A conveying device for feeding sheet-like products to a processing machine for printed products, comprising:

a stationary framework;

a carrier mounted for movement in a first direction along a self-contained path on said stationary framework;

carrying elements secured to said carrier and arranged one behind the other such that they are driven in said first direction along said self-contained path;

a carrying arm and a link member pivotally connected to said carrying element;

a clamp including first and second interacting clamping jaws pivotally mounted on each carrying arm, said clamping jaws being prestressed in the closed direction;

said first clamping jaws connected to said link member for pivoting said clamp;

a stationary actuating member secured to said stationary framework;

opening members supported through said carrying arms;

said second clamping jaws connected to an opening members that can be acted upon by said stationary actuating member to open said clamp; and a control device that controls said carrying arms and link members separately in order to pivot said clamps about their pivotal connection on said carrying arms independently of the movement of the carrying arms.

2. The conveying device as claimed in claim 1, wherein said opening member comprises a roller; and said second clamping jaw being connected through a control linkage to said opening member.

3. The conveying device as claimed in claim 1 wherein the conveying device further comprises:

a control ring secured to said stationary framework;

an actuating member including an opening guide, removably mounted on said control ring.

4. The conveying device as claimed in claim 1, wherein the conveying device further comprises:

said link member including a control lever;

a connecting rod having first and second ends;

said first end of said connecting rod being connected to said first clamping jaw;

said second end of said connecting rod being pivotally connected to said control lever;

said link member including a follow-on member mounted thereon;

said carrying arm including a follow-on member mounted thereon; and said control device including guide tracks formed therein that receive said follow-on members.

5. The conveying device as claimed in claim 2, wherein the conveying device further comprises:

said link member including a control lever;

a connecting rod having first and second ends;

said first end of said connecting rod being connected to said first clamping jaw;

said second end of said connecting rod being pivotally connected to said control lever;

said link member including a follow-on member mounted thereon;

said carrying arm including a follow-on member mounted thereon; and said control device including guide tracks formed therein that receive said follow-on members.

6. The conveying device as claimed in claim 3, wherein the conveying device further comprises:

said link member including a control lever;

a connecting rod having first and second ends;

said first end of said connecting rod being connected to said first clamping jaw;

said second end of said connecting rod being pivotally connected to said control lever;

said link member including a follow-on member mounted thereon;

said carrying arm including a follow-on member mounted thereon; and said control device including guide tracks formed therein that receive said follow-on members.

7. The conveying device as claimed in claim 4, wherein the conveying device further comprises:

said second clamping jaw including a pulling member;

a spring connected at one end to said connecting rod and at its other end to said pulling member causing said clamping jaws toward the closed position.

8. The conveying device as claimed in claim 1, wherein the conveying device further comprises:

said processing machine including a plurality of wall elements;

said second clamping jaw including a roller shaped press-on element that is adapted to force the product against one of said wall elements and to open said clamp such that the product is released.

9. The conveying device as claimed in claims 1, wherein the conveying device further comprises:

said carrying elements being arranged on said rotationally driven carrier such that said carrying elements follow a circular rotational path.

10. An apparatus for processing printed products, including a processing machine for printed products and a conveying device for feeding sheet-like products to a processing machine for printed products, comprising:

a stationary framework;

a carrier mounted for movement in a first direction along a self-contained path on said stationary framework;

carrying elements secured to said carrier and arranged one behind the other such that they are driven in said first direction along said self-contained path;

a carrying arm and a link member pivotally connected to said carrying element;

a clamp including first and second interacting clamping jaws pivotally mounted on each carrying arm, said clamping jaws being prestressed in the closed direction;

said first clamping jaws connected to said link member for pivoting said clamp;

a stationary actuating member secured to said stationary framework;

opening members supported through said carrying arms;

said second clamping jaws connected to an opening members that can be acted upon by said stationary actuating member to open said clamp;

a control device that controls said carrying arms and link members separately in order to pivot said clamps about their pivotal connection on said carrying arms independently of the movement of the carrying arms;

said conveying device includes a delivery location and a transfer region and wherein:

said sheet-like products are grasped by said clamps as said clamps move past said delivery locations and are transferred to said transfer region for discharge to said processing machine.

11. The apparatus as claimed in claim 10, wherein the apparatus further comprises:

said processing machine including a plurality of rotationally driven wall elements which are arranged at intervals one behind the other in the direction of movement;

said wall elements extending transverse to their direction of movement and form saddle-like rests onto which the printed products can be deposited in a straddling manner;

said wall elements also forming pocket-like receiving parts between adjacent wall elements into which the printed products can be inserted;

and wherein the movement direction of said wall elements in the transfer region being approximately the same as the direction of rotation of said conveying device; and wherein said control device functions to controls said carrying arms and link members such that, in the transfer region, the clamp mouth of said clamps formed by said clamping jaws, extends approximately in the direction of the corresponding wall elements.

12. The apparatus as claimed in claim 11, wherein the apparatus further comprises:

said products being in the form of folded printed sheets and the clamps function to grasp a printed sheet at its fold at the delivery location, and transport said printed sheet to said transfer region with the open edge that is located opposite the fold, in front, as seen in the direction of rotation;

an opening unit arranged at the beginning of the transfer region, said opening unit functioning to temporarily retain a part of the printed sheet, raise it away from the other part of the printed sheet with the result that one of said wall element can move in between the raised-apart parts of the printed sheet; and said stationary actuating member being located in the end section of said transfer region and interacting with said opening members to open said clamps, and to release the printed sheets, such that the printed sheets come to rest in a straddling manner on the rests of the wall elements.

* * * * *